United States Patent [19]

Hazard

[11] Patent Number: 4,984,560

[45] Date of Patent: Jan. 15, 1991

[54] LOW EMISSIONS WOOD BURNING STOVE

[75] Inventor: Gary M. Hazard, Morristown, Vt.

[73] Assignee: N.H.C., Inc., Morrisville, Vt.

[21] Appl. No.: 399,237

[22] Filed: Aug. 28, 1989

Related U.S. Application Data

[62] Division of Ser. No. 229,270, Aug. 8, 1988, Pat. No. 4,862,869.

[51] Int. Cl.[5] ..... F23H 11/20

[52] U.S. Cl. ..... 126/169; 126/174; 126/540; 126/541

[58] Field of Search ..... 126/77, 540, 541, 542, 126/543, 532, 79, 83, 242, 244, 152 R, 152 B, 174, 169, 192, 286, 295; 110/210–214, 268, 328

[56] References Cited

U.S. PATENT DOCUMENTS

| | | | |
|---|---|---|---|
| 2,112,272 | 3/1938 | DeLin | 126/287 |
| 2,790,401 | 4/1957 | Hebert | 126/174 X |
| 4,363,785 | 12/1982 | Willson | 110/211 X |
| 4,426,991 | 1/1984 | Stevenson | 126/174 X |
| 4,646,712 | 3/1987 | Ferguson et al. | 110/214 X |

*Primary Examiner*—Larry Jones

*Attorney, Agent, or Firm*—Chilton, Alix & Van Kirk

[57] ABSTRACT

A wood burning stove incorporates a catalytic cell for reducing exhaust emissions from the stove. A pair of heat shields are spaced from opposing surfaces of a combustor to exchange thermal radiation with the combustor. The combustor is oriented at an acute angle to enhance the combustor life. One of the heat shields also functions as a deflector for deflecting exhaust toward the combustor. A secondary air unit supplies secondary air to the vicinity of the combustor. A dynamic grate assembly is employed to prevent under firing of the firebox.

6 Claims, 6 Drawing Sheets

LOW EMISSIONS WOOD BURNING STOVE

This is a divisional of copending application Ser. No. 229,270 filed Aug. 8, 1988 now U.S. Pat. No. 4,862,869.

BACKGROUND OF THE INVENTION

This invention relates generally to systems for controlling the emissions of pollutants from wood burning stoves. More particularly, this invention relates generally to systems for oxidizing combustibles in the exhaust gases generated by the primary combustion of a wood burning stove.

Environmental and regulatory concerns have resulted in increasing regulation and stricter requirements as to the acceptable level and quality of exhaust emissions which may be generated by wood burning stoves. The Federal Environmental Protection Agency has mandated that wood burning stoves manufactured after July 1, 1988 comply with strict emission standards. Most conventional wood burning stoves do not meet the emission regulations of the Environmental Protection Agency. A number of systems have been advanced for reducing the pollutants of the exhaust gases produced by the primary wood burning combustion. Some systems have involved catalytic converters or combustors for facilitating the secondary combustion of exhaust pollutants. A number of conventional systems which are effective in reducing pollutants are not effective under all conditions such as when the ash pan is opened and an "under fire" condition is produced in the firebox.

Van Dewoestine U.S. Pat. No. 4,373,452 discloses a wood burning stove which employs a catalytic burner converter for oxidizing various uncombusted matter in the exhaust produced by the primary combustion. In one embodiment, the catalytic burner is located in the flue immediately adjacent the combustion chamber of the stove. The catalytic converter may also be situated in the combustion chamber. The catalytic converter is a cellular ceramic honeycomb structure with a plurality of mutually parallel cells extending through the converter. The catalytic converter may have a variety of forms such as a ceramic monolith having an alumina washcoat and coated with a precious metal catalyst such as palladium, platinum or alloys of the materials. A means for providing secondary air in the vicinity of the catalytic converter is also provided to enhance the operation of the catalytic converter.

Catalytic combustors of the type having a ceramic honeycomb substrate and precious metal catalyst coatings have been employed in connection with wood burning stoves for a number of years for facilitating the combustion of products in the exhaust from the primary combustion. The application of catalytic combustors in wood burning technology has engendered a number of problems. For example, non-uniform catalyst temperatures tend to cause cracking of the combustor substrates. The conventional vertical cell orientation for the normal exhaust flow path results in conventional catalyst combustors being vulnerable to premature failure due to the ceramic chips falling out of the combustors. Bulky metal housings also result in the heat up time of the catalytic combustors being relatively slow. The effectiveness of catalytic combustors can also be easily compromised under various conditions.

SUMMARY OF THE INVENTION

Briefly stated, the invention in a preferred form, is a wood burning stove having a firebox which constitutes the primary combustion chamber. A catalytic cell is incorporated into the wood stove. The catalytic cell forms a secondary combustion chamber within the stove which communicates with the primary combustion chamber. A catalytic combustor is disposed in the secondary chamber for catalytically combusting the exhaust from the primary combustion. An exhaust path is formed in the catalytic cell, so as to extend from the cell inlet through the combustor to the cell outlet. A heat shield assembly is employed to exchange thermal radiation with the combustor. A first shield is disposed between the cell inlet and the combustor, and a second heat shield is disposed between the combustor and the cell outlet. The exhaust path through the cell extends generally in a first direction from the inlet to the first heat shield and generally reverses direction from the first shield to the combustor.

The secondary catalytic chamber is thermally isolated by insulation. The combustor is a honeycomb-like substrate which comprises an array of cells defining passages extending along generally parallel axes. The combustor is preferably mounted so that the axes extend at an angle of approximately 15° relative to a horizontal plane through the stove. The combustor has a substantially rectangular shape with the exhaust path traversing two opposing surfaces of the combustor. The other surfaces of the combustor are covered with thermal insulation.

A shell constitutes the principal housing and support structure for the catalytic cell and includes a pair of spaced rails which are mounted interiorly of the shell. A tray which rests on the rails supports the combustor.

A secondary air unit supplies secondary air to the secondary catalytic chamber. A valve is responsive to temperature in the secondary chamber for controlling the supply of the secondary air. The position of the valve is controlled by a bimetallic member.

In accordance with another feature of the invention, a moveable grate is mounted on a stationary grate and is slidably positionable between first and second positions. In the second position, openings on the moveable grate communicate with corresponding openings on the stationary grate to provide sufficient communication to allow ash to pass from the firebox to the ash pan. In the first position, the openings of the moveable grate and the stationary grate do not align and there is no air communication through the openings. A handle is pivotally connected to the moveable grate and is engageable with the door so that when the door is closed the moveable grate is forced to the first position. A stop cooperates with the handle to limit the angular pivoting of the handle.

An object of the invention is to provide a new and improved wood burning stove which produces low levels of emissions and complies with applicable pollution control standards.

Another object of the invention is to provide a new and improved catalytic combustor system for a wood burning stove which is highly effective over a wide range of operating conditions.

Another object of the invention is to provide a ne and improved secondary combustion system for a wood burning stove which satisfies the demanding regulatory emission standards while the wood burning stove efficiently operates over a relatively wide power output range.

A further object of the invention is to provide a new and improved catalytic combustor system which is highly reliable, has an enhanced catalytic combustor effective lifetime and is relatively easy to operate and maintain.

A further object of the invention is to provide a new and improved catalytic combustor system which may be efficiently incorporated into a wood burning stove to automatically provide a high degree of particulate emission control over a wide range of operational conditions including conditions wherein the ash pan is opened.

Other objects and advantages of the invention will become apparent from the drawings and the specification.

DETAILED DESCRIPTION OF THE INVENTION

With reference to the drawings wherein like numerals represent like parts throughout the several figures, a wood burning stove which is capable of operating within strict emission and pollution control standards over a wide range of operating conditions is generally designated by the numeral 10.

Figure 1:
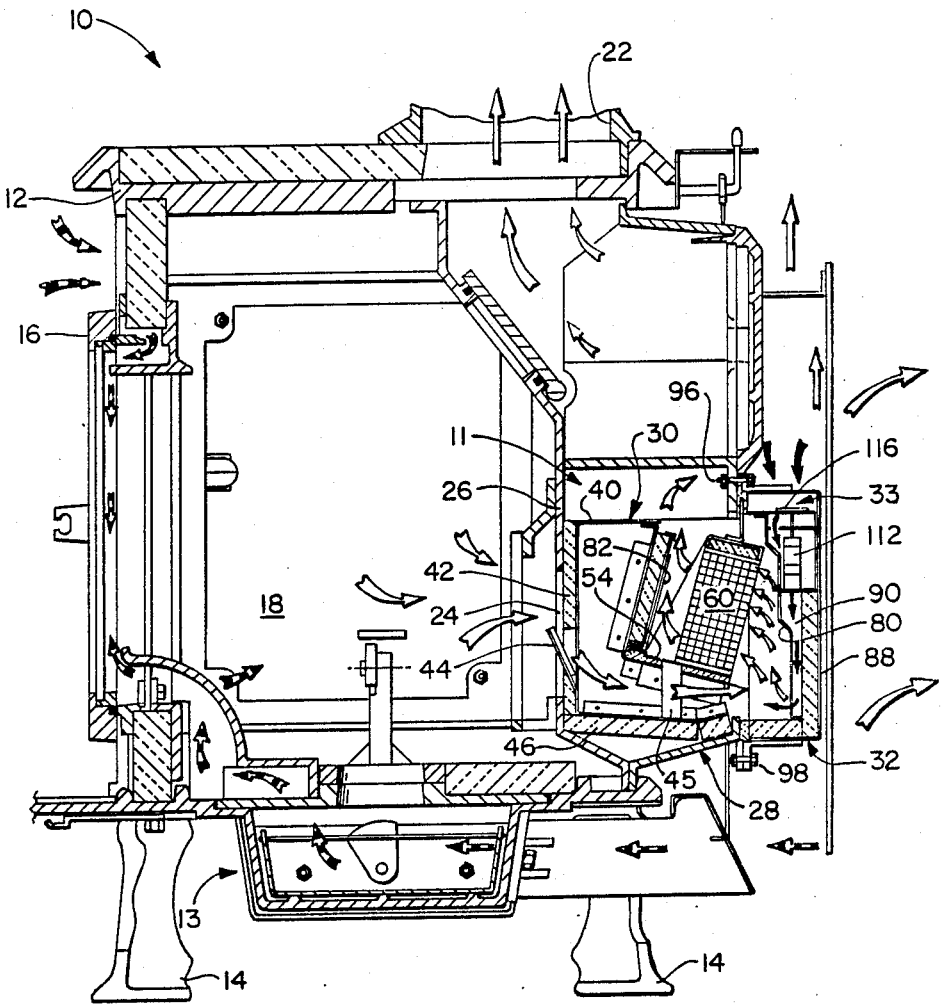
FIG. 1 is a side sectional view, partly in schematic, of a wood burning stove incorporating a catalytic combustor cell in accordance with the present invention.
Figure 2:
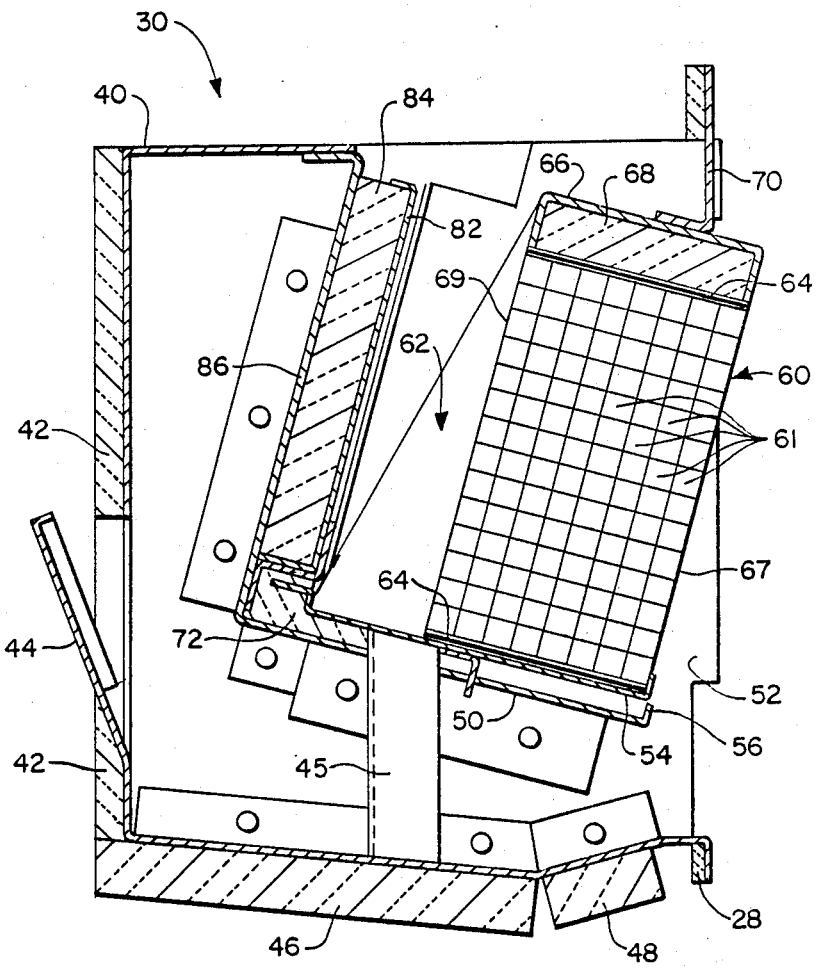
FIG. 2 is an enlarged fragmentary sectional view of the catalytic combustor cell of FIG. 1.
Figure 3:
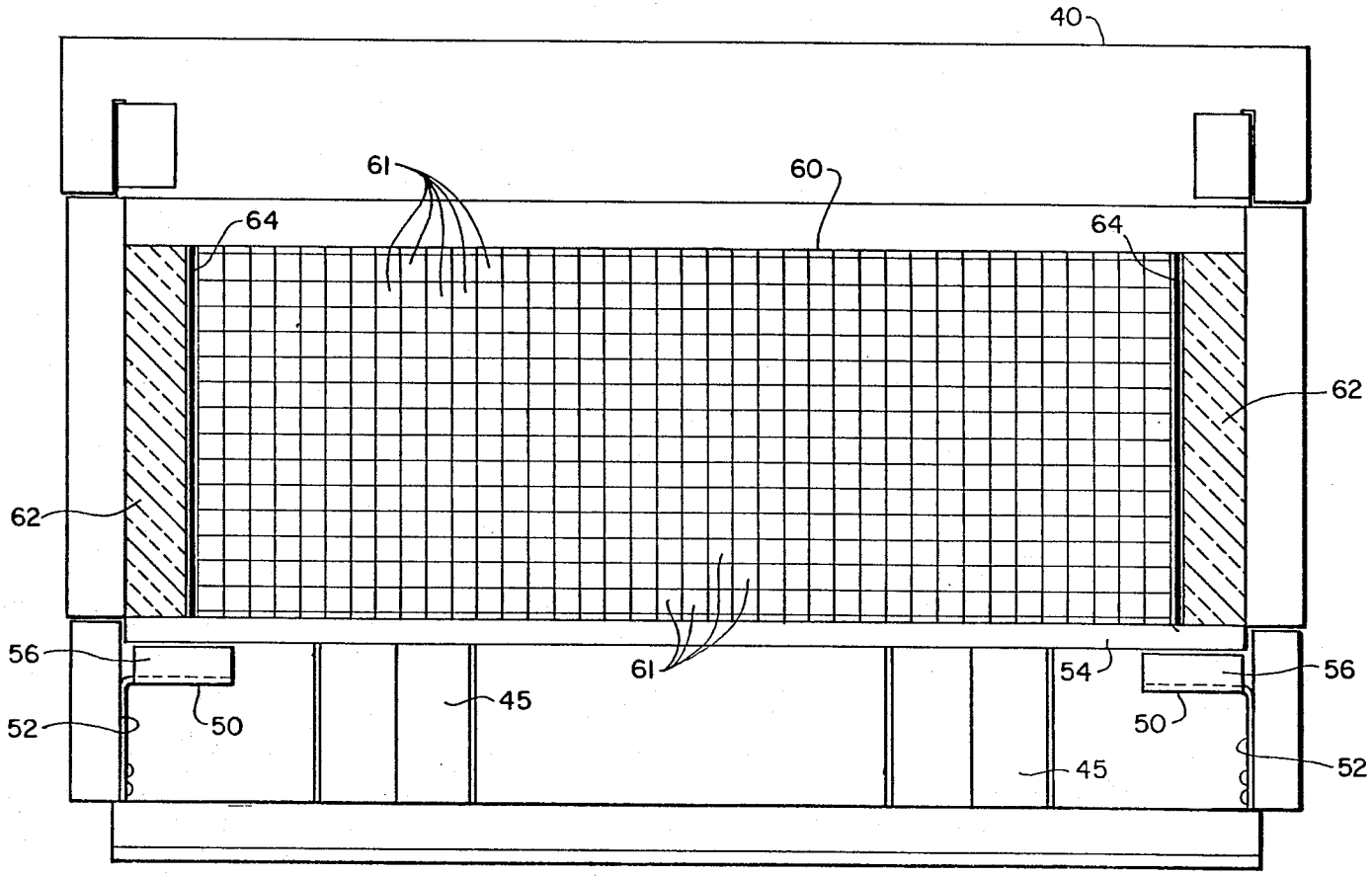
FIG. 3 is an interior view of the catalytic combustor cell of FIG. 2 viewed from the right rear thereof.
Figure 6:
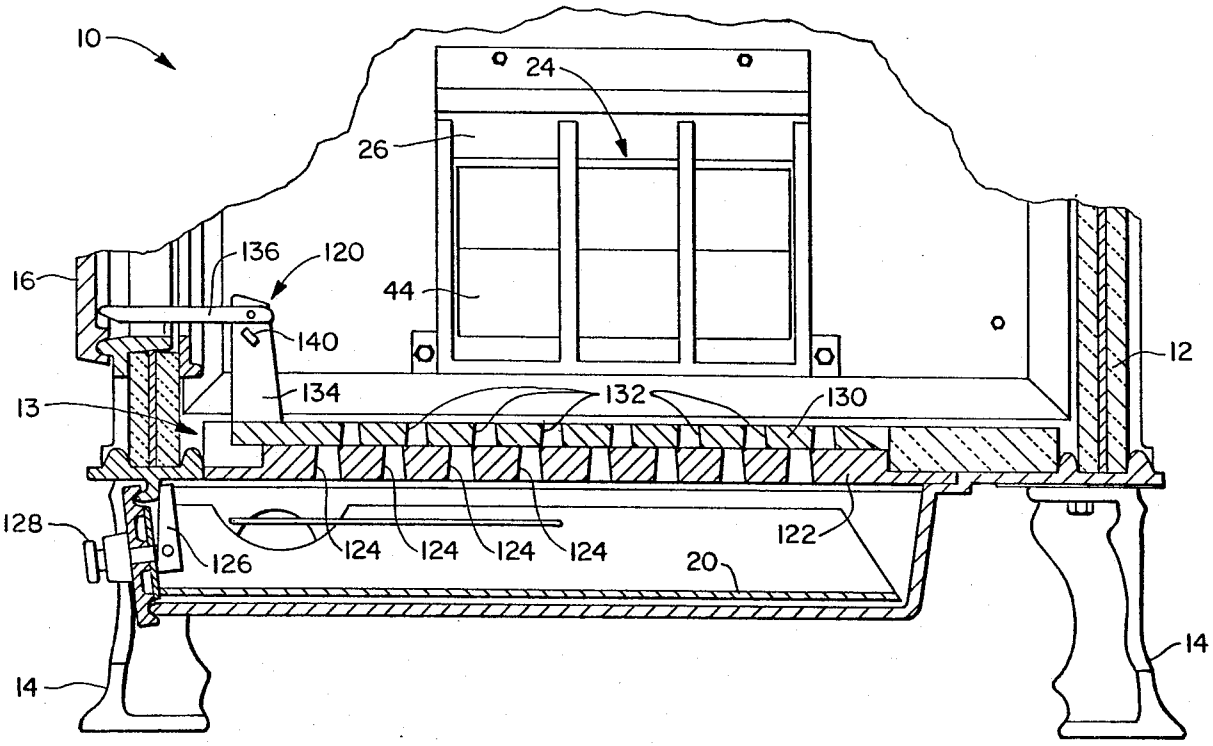
FIG. 6 is an enlarged fragmentary frontal sectional view, partly broken away, of the wood burning stove of FIG. 1.

The stove 10 incorporates a catalytic combustor assembly 11 illustrated in FIGS. 1–3 and a dynamic grate assembly 13 best illustrated in FIG. 6. Wood burning stove 10, excepting for the catalytic combustor assembly and the dynamic grate assembly hereinafter described, may assume any of a number of forms. Stove 10 generally includes a housing 12 of cast iron, soapstone or other suitable material. The housing 12 is supported on four legs 14. A door 16 or a pair of doors is located at the front of the housing for accessing a centrally located firebox chamber 18. An ash pan 20 is located below the firebox chamber. An exhaust opening 22 at the upper rear of the housing leads to an exhaust flue (not illustrated) in a conventional manner. Wood burning stove 10 is preferably of a compact construction which provides for an efficient controlled combustion of fuel received in the firebox chamber 18. The exhaust from the primary combustion exits through a rear opening 24 in the rear wall 26 of the firebox chamber. The combustion exhaust stream ultimately traverses through the combustor assembly 11 and downwardly through a baffle to exit the stove housing through the exhaust opening 22. Regulation of air to the firebox chamber is controlled by conventional means. The air stream for primary combustion is schematically denoted by broken arrows in FIG. 1.

The catalytic combustor assembly 11 includes a catalytic combustor cell 30 which is located interiorly of the stove housing at the rear of the firebox chamber 18. The catalytic combustion cell 30 functions as a secondary combustion chamber to facilitate catalytic combustion of the uncombusted products or exhausts of the primary combustion in the firebox chamber. The exhaust flow path through the wood burning stove is generally schematically represented by the closed arrows in FIG. 1 As will be detailed below, the catalytic cell 30 has a rugged stainless steel construction and is thermally insulated to provide a highly durable and efficient secondary combustor unit within the wood burning stove. The catalytic combustion cell 30 in a preferred embodiment has a relatively fast response time and is capable of operating at relatively high temperatures. The catalytic combustor cell is constructed to compensate for thermal fluctuations and to provide a more uniform temperature distribution within the cell, as will be more fully described, so as to provide a highly efficient secondary combustion of the exhausts which exit the firebox chamber 18.

The cell 30 is enclosed by a rear cover module 32 which includes a secondary air unit designated generally by the numeral 33. The secondary air unit 33 is positioned rearwardly adjacent the catalytic combustor cell to provide secondary air for enhancing the catalytic combustion of the primary exhaust. The flow of secondary air is generally represented by the solid arrows in FIG. 1.

With additional reference to FIGS. 2 and 3, the catalytic combustor cell 30 comprises a stainless steel combustor shell 40 which is spaced from the rear wall 26 of the firebox chamber. The combustor shell 40 functions a the principal housing and support structure for the combustor cell. An insulation blanket 42, such as a Dura blanket, is interposed between the shell and the firebox wall 26 to provide a blanket of thermal insulation for the catalytic cell. An integral flap 44 of the combustor shell is bent forwardly through the opening 24 in the rear wall of the firebox to provide a chute for guiding the exhaust gases produced by the primary firebox combustion into the interior of the catalytic cell. V-shaped smoke deflectors 45 extend generally upwardly from the shell floor. The floor of the combustor shell has a bent configuration to conform to the stove dimensions and to facilitate mounting to a vertically projecting shoulder of the rear housing strut 28 of the illustrated wood stove. The rear of the shell is bent to form peripheral flanges (FIG. 3) for mounting the shell in the stove. Ceramic boards 46 and 48 are inter-positioned below the floor of the housing shell. The ceramic boards 46 and 48 function to thermally isolate the interior of the combustor cell.

A pair of rails 50 are mounted at opposing end side walls 52 of the combustor shell for supporting a combustor tray 54. The combustor tray 54 forms a generally planar receiving surface which is oriented at an angle of approximately 15° relative to the horizontal plane and extends generally parallel between opposing sides of the stove. The rails 50 slope downwardly from front to rear. The combustor tray 54 also rests on the tops of deflectors 45 which also have a 15° slope. The combustor tray 54 receives and supports the catalytic combustor 60 and defines the angular orientation of the combustor as will be detailed below. The tray 54 freely rests on the rails 50 and deflectors 45 and is slidable along the rails 50 for easy removability from the cell. Retaining flanges 56 at the rear of the rails engage the rear edge of the combustor tray to retain the tray in position.

In preferred form, the catalytic combustor 60 has a rectangular shape dimensioned approximately nine inches long, two inches wide and three and one-half inches high and has a conventional honeycomb-type ceramic substrate forming a plurality of cells 61. The cells 61 have surfaces coated with a catalytic material which facilitates combustion of the impinging exhausts. In one preferred embodiment, the combustor element comprises a Long Life catalytic combustor marketed by Corning Glass. The latter combustor element has a rectangular brick-like shape with approximately twenty-five cells per square inch. Other catalytic combustors may also be suitable.

With reference to FIG. 3, the opposing side ends of the catalytic combustor are enclosed by ceramic boards 6 to provide thermal insulation of the combustor. A heat activating sealing compound 64, such as Interam Compound marketed by Minnesota Mining & Manufacturing Company is applied to the ends of the combustor to seal between the combustor 60 and the ceramic board 62. The sealing compound is also applied to the upper and lower surfaces of the combustor 60. A steel cap 66 encloses a rectangular ceramic board 68 positioned above the combustor. The cap 66 extends transversely for securing the combustor 60 in position. A brace 70 in the form of an angular element extends from the top of the cap for securing the cap to an upper support structure of the stove. The bottom of the combustor is also thermally insulated by a Dura insulation blanket 72 which is positioned against the frontal underside of the combustor tray 54. The described mounting configuration essentially provides two spaced uncovered combustor surfaces 67 and 69 which generally function as inlet and outlet planes, respectively, for the exhaust stream traversing the combustor.

The exhaust gases from the firebox enter a lower region of the combustor cell and are initially directed rearwardly under the combustor tray 54. The catalytic combustor 60 is interposed between two radiation heat shields 80 and 82 which are essentially positioned upstream and downstream in the exhaust gas path which extends through the catalytic cell. The upstream shield 80 is a rear radiation shield which is formed from stainless steel. The shield 80 is a component of the rear cover module 32 for the catalytic cell unit, and in part, functions to deflect the impinging exhaust gases toward the combustor 60. As illustrated in FIG. 1, the exhaust gases from the firebox pass through the opening 24 and are directed below the insulated underside of the combustor tray assembly to impact against the radiation shield 80 for deflection toward the surface 67 of the catalytic combustor.

The rear radiation shield 80 is spaced from the rear surface 67 of the combustor and is shaped to distribute the exhaust gases substantially across the entire rear surface 67. The forward or downstream radiation shield 82 is spaced from the combustor and oriented generally parallel to the exiting plane, e.g., the front surface 69, of the catalytic combustor. Shield 82 is also preferably formed of stainless steel. The downstream shield 82 is insulated by a ceramic board 84 and a secondary shield 86 which abuts the front surface of the ceramic board 84. The secondary shield 86 is fastened at the top underside to the combustor shell 40 and is also fastened at the side end walls of the combustor shell to essentially rigidly orient the upstream shield assembly comprising shields 82 and 86 at approximately a 15° angle to the vertical in generally parallel relationship to the front face 69 of the exiting plane of the catalytic combustor 60. The angular orientation of the combustor produces an exhaust path through the combustor which is approximately at a 15° upward slope from combustor surface 67 to surface 69.

The rear upstream radiation shield 80 and the downstream radiation shield 82 cooperatively function in conjunction with the described ceramic thermal insulation to provide a rapid catalytic system response, high temperatures within the catalytic cell and a relatively homogeneous uniform temperature profile across the catalytic combustor. The radiation shields 80 and 82 essentially function in a thermal flywheel-type fashion to continually return a portion of the cell thermal energy to the catalytic combustor 60 in the event there is an intermittent loss of fuel exhaust through the combustor. The transfer of thermal energy from the radiation shields to the catalytic combustor via radiation functions to maintain high combustor temperatures despite intermittent fluctuations in the source of fuel exhausts from the combustion of the wood.

The spatial orientation of the combustor 60 and heat shields 80 and 82 enhances the exchange of energy between the combustor and the shields. The view factor may be described as the quantity of energy radiated by one surface which is intercepted by a second surface compared to the quantity of energy radiated by the one surface. For one embodiment of the described combustor assembly 11, the view factor for energy radiated from combustor surface 67 to shield 80 is approximately 65% and the view factor for energy radiated from combustor surface 69 to shield 82 is approximately 73%. For the reverse exchanges, the view factor for energy radiated from shield 80 to combustor surface 67 is approximately 44% and the view factor for energy radiated from shield 82 to combustor surface 69 is approximately 64%. For the one embodiment as described, the downstream shield 82 is generally equidistantly spaced from combustor surface 69 approximately 1¼ inch. The spacing between combustor surface 67 and shield 80 varies with a minimum spacing of approximately ¾ inch.

The rear radiation shield 80 also protects the outer mild steel rear cover 88 of the module 32 from the high temperatures within the catalytic cell. Surface combustion may occur on the rear radiation shield 80 by virtue of combustor cell temperatures as high as 1600° F., which exceeds the smoke ignition temperature, and the 180° directional reverse or deflection in the exhaust path due to the exhaust path impinging the rear radiation shield 80. Flame impingement on the catalytic combustor 60 is minimized because the flames are extinguished by contact with the surfaces of the catalytic cell and especially the rear cover radiation shield 80. The rear radiation shield 80 also functions as a heat exchanger to preheat incoming secondary air for the catalytic combustion as will be detailed below.

Figure 4:
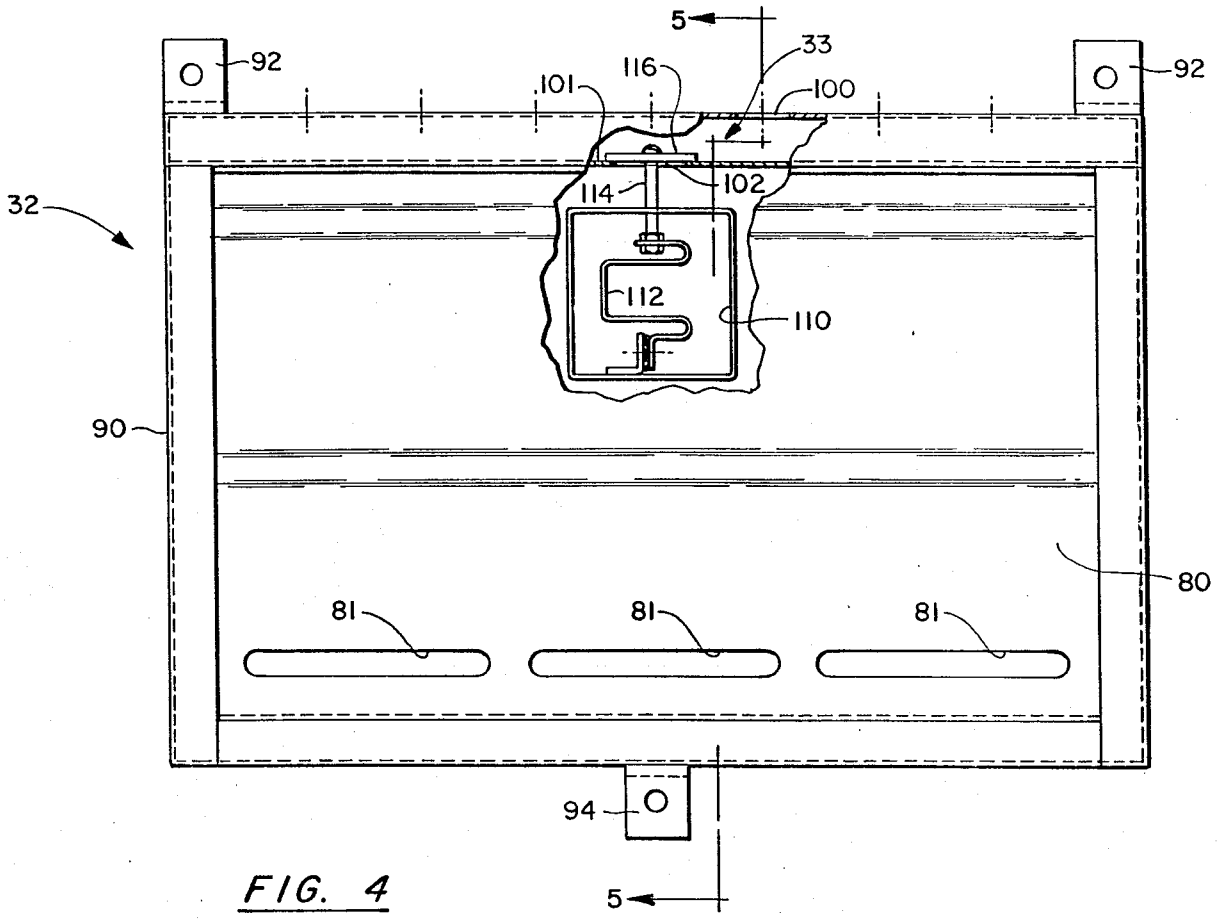
FIG. 4 is an interior view, partly broken away and partly in phantom, of the rear cover portion of the catalytic combustor cell of FIG. 1.
Figure 5:
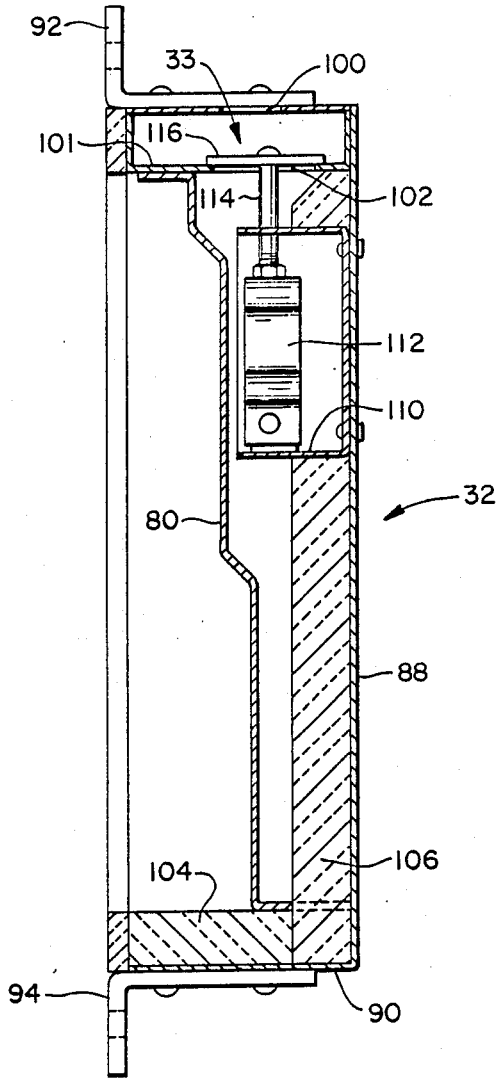
FIG. 5 is an enlarged fragmentary sectional view of the rear cover portion taken along the line 5—5 of FIG. 4.

With additional reference to FIGS. 4 and 5, the secondary air unit 33 provides secondary air to the catalytic combustor cell 30 in accordance with the requirements of the catalytic combustor 60. When the combustor cell has a temperature of approximately a few hundred degrees, the secondary air unit supplies no or little air to the combustor cell. The oxygen required for the catalytic combustor is supplied with the smoke in the exhaust from the firebox. As the temperature of the catalytic combustor increases, additional air is required for effective combustion. The secondary air unit 33 functions to provide the required air. The secondary air unit also functions to decrease the supply of secondary air when the combustor cell is cooling down. Consequently, excessive cooling of the catalytic combustor is avoided and the potential for damage to the combustor 60 due to thermal gradients is lessened.

The rear cover module 32 comprises a rectangular housing 90 mounted at the rear of the catalytic combustor cell 30 for housing the secondary air unit 33. Two transversely spaced mounting brackets 92 are riveted to the top panel of the housing, and a centrally located mounting bracket 94 is mounted to the lower panel of the housing. The mounting brackets 92 and 94 are bolted to rear portions of the stove by bolts 96 and 98, respectively, to secure the module 32 in position. It should be appreciated that the module 32 is easily removed for access to the combustor 60 by removing the bolts 96 and 98.

The top panel has a series of transversely spaced inlet openings 100. A panel 101 extends interiorly of the housing 90 generally parallel to the top panel of the housing. Panel 90 has a central opening 102 which functions as the valve opening for the secondary air unit. The steel plate which forms the rear shield 80 is bent at the top portion and riveted to a front portion of the panel 101 to form the upper support of the shield. The plate forming the rear shield 80 is also bent in a compound fashion to form three vertical portions and is bent proximate the bottom terminus to form a leg for supporting the rear shield in the housing 90.

Three slots 81 at the lower portion of the shield 80 form openings for supplying secondary air to the combustor cell. Ceramic insulator boards 104 and 106 are positioned at the rear and bottom interior sides of the cover housing 90 to form an insulated air plenum which extends from the valve opening 102 downwardly between the rear surface of shield 80 and the front surface of the ceramic insulator board 104. As previously described, the shield 80 functions as a radiator heat shield for the combustor 60 as well as a deflector for deflecting the exhaust toward the combustor. In addition, the shield defines the secondary air plenum for the combustor as well as to provide a protective shield for protecting the rear panel 88 of the housing 90 from the intense heat of the exhaust or flue gases.

A rectangular box 110 is mounted at an upper rear interior portion of the housing 90. The box may be secured by rivets or other suitable fasteners. A bimetallic strip 112 is anchored at a bottom portion of the box. A control rod 114 connects with the upper portion of the metallic strip. The control rod extends vertically through the upper panel 101 of the box. A circular valve cover 116 is mounted at the top of the control rod 114. The valve cover selectively opens and closes the opening 102 in accordance with the state of the bimetallic strip. The control rod may be threadably adjusted to obtain the optimum pre-established valve control for a given temperature. At relatively low temperatures, the bimetallic strip is folded to essentially force the valve cover 116 to close the opening 102 so that no secondary air is supplied to the vicinity of the catalytic combustor 60.

As the temperature of the catalytic combustor increases, the temperature is radiated to the rear shield 80 which heats and causes the adjacent bimetallic strip 112 to deform so that the valve cover 116 is pushed (vertically) from the opening to allow the secondary air to be supplied to the vicinity of the combustor. The flow path of the secondary air is denoted by solid arrows in FIG. 1. As the demand for oxygen continues to increase with elevated combustor temperatures, the bimetallic element 112 further expands due to the higher output from the combustor thereby opening the valve to provide additional oxygen. During the cool-down of the combustor, the reverse process occurs. Decreasing temperature and heat output from the catalytic combustor cause the bimetallic element to contract. Secondary air flow is curtailed and excessive cooling is avoided. It should be appreciated that the activated secondary air valve automatically functions to provide faster heat up times at the beginning of the combustion and slower cool down times at the end of the combustion. The secondary air is essentially added to the catalytic cell as required during the time interval when it is required.

The catalytic combustor cell 30 is constructed of a rugged stainless steel and ceramic fiber insulation construction so that the cell is capable of withstanding both the high temperatures of catalytic combustion and the damaging effects of thermal cycling. An 18 SR stainless steel alloy marketed by Armco of Middletown, Ohio is a suitable material for the shell, heat shields and combustion tray due to the favorable alloy properties of being able to withstand high temperatures and large thermal fluctuations. In one embodiment, the catalytic cell has a relatively fast thermal response wherein the temperature increases from a typical room temperature to 1000° F. in approximately 55 minutes at low burn. The high temperature insulation contributes to the durability of the cell as well as minimizing conduction heat loss from the catalytic combustor. The relatively small conduction losses function to provide a relatively fast response time, a high peak system temperature range on the order of from 1500° F. to 1600° F., and a relatively uniform temperature distribution across the expanse of the combustor.

An additional feature of the catalytic cell is the flow pattern of the combustion products which exit the cell. The path of hot smoke or exhaust divided at the exit to flow downward past the left and right sides of the stainless steel structure. The exhaust path from the combustor cell is denoted by closed arrows in FIG. 1. Heat from the exhaust gases is given up to the catalytic cells 61 as the gases cool from approximately 1500° F. to 800° F. to 1000° F. The heat energy helps maintain the elevated uniform combustor temperatures.

The catalytic combustor 60 may be easily accessed by removing the bolts 96 and 98 which fasten the rear cover module 32 in place. After the module 32 is removed, the uprightly positioned catalytic combustor is readily visible for inspection by the dealer, chimney sweep, consumer or as required. The catalytic tray 54 is designed to easily slide out for ready inspection of the combustor.

The approximate 15° angular orientation of the catalytic combustor provides an efficient exhaust stream flow while enhancing the effective useful life of the combustor. The efficient upward flow of exhaust through the combustor cells 61 is assured by the slightly non-vertical orientation of the combustor. At the same time, any erosion of the catalytic combustor due to the dislodging of cracked pieces is also lessened by orienting the combustor so that the combustor cell passage axes extend at an approximate 15° angle from the horizontal. The combustor is effective even when the catalytic surface is cracked or chipped from the thermal gradients and high temperatures.

Upon ignition of the wood in the firebox, the catalytic combustor cell functions in an efficient and reliable manner to combust the wood smoke to thereby produce relatively low levels of exhaust emissions. The operation of the catalytic cell is automatic since the combustor and bimetallic secondary air valve operate in concert in response to temperature. The air is supplied or restricted by the secondary air valve according to the temperature of the catalytic combustor system. During the normal operation of the stove, essentially no adjustments are required for the catalytic cell.

With additional reference to FIG. 6, the stove further includes a dynamic grate assembly 120 which functions to further insure that the favorable low emission characteristics of the stove are achievable over a wide range of operating conditions and throughout the normal operational sequence of the stove. The ash pan 20 is slidably received in a carrier 21 positioned in conventional relationship below a stationary grate 122 located at the bottom of the firebox chamber. The stationary grate has a series of openings 124 which allow for the ash or residue from the primary combustion to drop through the firebox floor into the ash pan 20. The ash pan further includes a latch 126 and a pivotal handle 128 for latching the ash pan in the closed position illustrated in FIG. 6.

It is well known that the openings 124 of a stationary grate may also function as air inlets to the firebox chamber. Some stove operators open the ash pan to enhance the oxygen supply to start combustion in the wood stove. However, the introduction of air through the grate below the firebox chamber produces an oxygen rich combustion condition commonly known as "under fire" wherein the combustion at the lower positions of the fuel the burns at a very high temperature and the combustion in the upper portion of the fuel burns at a lower temperature resulting in the emissions of relatively high levels of exhaust or pollutants.

In accordance with one feature of the low emissions stove 10, a second moveable grate 130 is mounted to rest on the stationary grate 122. The moveable grate is a plate-like member having a series of openings 132 The openings 132 are dimensioned and spaced so that they do not communicate with the openings 124 of the stationary grate in the normal position when the stove doors are closed, as illustrated in FIG. 6. The moveable grate 130, however, is slidable across the stationary grate 122 (toward the left in FIG. 6) so that openings 132 communicate with corresponding openings 122. Naturally, such communication is required to permit removal (through the openings) of ash from the firebox to the ash pan.

A strut 134 projects upwardly from the moveable grate at an end location. A handle 136 is pivotally mounted at the upper portion of the strut. The handle 136 ordinarily projects transversely so as to be accommodated in the end panel of the door 16 when the door is closed. A stop 140 projects forwardly from a side of the strut below the handle to limit the angular displacement of the handle about its pivot.

When it is desired to remove ash from the firebox, the doors 16 are opened. The grate handle 136 may be grasped or the strut 134 engaged by a poker or suitable tool to slide the moveable grate transversely so that the openings 132 and 124 align or communicate to allow the ash to drop through the stationary grate into the ash pan 20. The ash pan may then be unlatched to allow the ash pan to be withdrawn from the carrier for emptying. The handle 136 cooperates with the door and associated structure so that when the door 16 is closing, the door essentially leverages against the front end of the handle to push or slide the moveable grate rearwardly to the position of FIG. 6 wherein the openings 132 are closed by the upper surfaces of the stationary grate 122.

It should be appreciated that the foregoing dynamic grate assembly 120 functions to close the grate during normal operating conditions so that air does not enter the primary combustion chamber through the bottom of the firebox. The moveable grate is essentially automatically moved into the correct position with the closing of the stove door 16.

The weight of the handle 136 urges the handle to the angular position of FIG. 6. An additional feature of the dynamic grate assembly is the pivoting handle which allows the handle to be pivoted upwardly (clockwise) in the event that an object becomes lodged or jammed between openings of the moveable grate and the stationary grate. Such a condition could prevent the moveable grate from being forced to its normal position of FIG. 6 and thus not allow the door to be closed, The pivoting handle feature provides an efficient safety backup means for closing the stove door 16 in an emergency condition wherein the jamming condition is sensed after the stove has been started. It should be appreciated, however, that the handle may be pivoted only to a limited degree before engaging stop 140. Thus, the handle will ordinarily fall to the normal position once the door is re-opened. Because the handle must be pivoted to close the door each time until the jamming condition is removed, the dynamic grate assembly essentially automatically imposes an incentive for the operator to remove any jamming between the grates to thereby insure that the low emissions characteristic of the stove is not defeated by under firing the firebox.

While a preferred embodiment of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A wood burning stove comprising:

firebox means for forming a chamber for primary combustion of fuel received therein;

door means comprising a door which may be opened and closed for selectively accessing said firebox means;

stationary grate means defining a first series of openings located in fixed position below said firebox means;

ash pan means comprising an ash pan disposed below said stationary grate means for receiving ashes from said firebox means;

moveable grate means defining a second series of openings, said moveable grate means being mounted above said stationary grate means and positionable between a first position wherein said first series of openings does not communicate with said second series of openings and a second position wherein said first series of openings communicate with said second series of openings to provide communication between said chamber and said ash pan means; and handle means connected to said moveable grate means for engagement from exteriorly of said firebox means for transforming said moveable grate means from said first position to said second position and engageable with said door so that when said door is closed, said moveable grate means is forced to the first position.

2. The wood burning stove of claim 1 wherein said handle is pivotally positionable.

3. The wood burning stove of claim 2 further comprising a stop which cooperates with the handle to limit the angular pivoting of the handle.

4. A wood burning stove comprising:

firebox means for forming a chamber for primary combustion of fuel received therein;

door means comprising a door which may be opened and closed for selectively accessing said firebox means;

first grate means defining a first series of openings located in fixed position below said firebox means;

ash pan means comprising an ash pan disposed below said first grate means for receiving ashes from said firebox means;

second grate means defining a second series of openings, said second grate means being mounted above said first grate means and transformable between a first position wherein said first series of openings does not communicate with said second series of openings and a second position wherein said first series of openings communicates with said second series of openings to provide communication between said chamber and said ash pan means; and reciprocating means connecting said second grate means and extending therefrom for reciprocating said second grate means between said first and second positions, said reciprocating means comprising a member mounted relative to said second grate means and engageable with the door so that when said door is closed, said second grate means is formed to the first position.

5. The wood burning stove of claim 4 wherein said member is pivotally positionable.

6. The wood burning stove of claim 5 further comprising a stop which cooperates with the member to limit the angular pivoting of the member.

* * * * *